US006926564B1

(12) United States Patent
Chen

(10) Patent No.: US 6,926,564 B1
(45) Date of Patent: Aug. 9, 2005

(54) STACKABLE BOARD-TO-BOARD MODULE CONNECTOR

(75) Inventor: Wen-Hsyung Chen, Taoyuan Hsien (TW)

(73) Assignee: Aces Electronic Co., Ltd., Taoyuan Hsien (TW)

( * ) Notice: Subject to any disclaimer, the term of this patent is extended or adjusted under 35 U.S.C. 154(b) by 22 days.

(21) Appl. No.: 10/833,074

(22) Filed: Apr. 28, 2004

(51) Int. Cl.[7] ..... H01R 13/502
(52) U.S. Cl. ..... 439/701; 439/541.5
(58) Field of Search ..... 439/610, 701, 439/541.5, 540.1

(56) References Cited

U.S. PATENT DOCUMENTS 5,052,949 A * 10/1991 Lopata et al. ..... 439/610
5,176,523 A * 1/1993 Lai ..... 439/64
6,036,551 A * 3/2000 Szczesny ..... 439/701
6,371,781 B1 * 4/2002 Jones et al. ..... 439/260

* cited by examiner

*Primary Examiner*—Briggitte R. Hammond
(74) *Attorney, Agent, or Firm*—Troxell Law Office, PLLC

(57) ABSTRACT

A stackable board-to-board module connector is mainly composed of a main module unit, at least one accessory module unit, several first terminals and second terminals. The main module unit combines with the accessory module unit to form a connector. The main module unit can be a standard device, while the accessory module unit can be an independent device that serves as a stackable accessory to adjust the height according to the total height requirement of board-to-board module connector. Through such a main module unit or a stack of several accessory module units, various height specifications can be achieved for a board-to-board module connector. In other words, it only needs to change the number of the accessory module units embedded in the bottom of the main module unit, the height requirement for a board-to-board module connector can be met. By this means, it is not necessary to prepare molds repeatedly.

2 Claims, 5 Drawing Sheets

STACKABLE BOARD-TO-BOARD MODULE CONNECTOR

BACKGROUND OF THE INVENTION

1. Field of the Invention

The present invention is related to a connector, especially a stackable board-to-board module connector which height is adjustable.

2. Description of the Related Art

The popular DDR (Doual Data Rate) memory module connector is a board-to-board module. Although there is no standard specification for its total height, the total height of a connector depends on the space configuration of a motherboard. This is prominent in notebook computer application. Different computer integrated device manufacturer has different requirement on the space configuration of a motherboard. Therefore, memory module connector manufacturers have to cope with this situation by preparing different dies and molds for being able to manufacture memory modules in different height specifications. Such an arrangement for manufacturing does not provide good economic efficiency.

For manufacturing memory module connectors, the process demands high precision and high technology. A number of dies and molds to manufacture memory module connectors in different height specifications actually add technical difficulty to manufacturing operation. It needs a huge investment in R&D to overcome process related issues, such as improving process stability and yield. Such an urgent technical issue, which the industry is facing and seeking solutions for, has to be integrated and resolved.

SUMMARY OF THE INVENTION

Based on the needs with respects to production cost and process technology for manufacturing memory module connectors, the inventor of the present invention developed a "stackable board-to-board module connector with adjustable total height" to satisfy the industrial needs.

The technical approach adopted in the present invention is to make a set of standard module unit and design an accessory module unit that is stackable under the main module unit. The accessory module unit can be an independent device to be adjustably installed under the main module unit according to the total height requirement for board-to-board module connector. This type of memory module connector is made from a main module unit or a stack of accessory module units.

If we need to manufacture a board-to-board module connector that is higher than the combination of a main module unit and an accessory module unit, we only need to adjust the number of accessory module units stacked under the main module unit. The mold design for the accessory module unit has lower technical requirement than the main module unit. So the installation cost will be greatly reduced. The only consideration is put on the control over entire surface accuracy for the accessory module unit, i.e. the compatibility with the main module unit with respect to combination. The overall technical requirement for a manufacturing process will be lower if the accessory module unit is included. For the sake of manufacturing cost, to manufacture board-to-board module connectors in different height specifications we only need a set of dies and molds for the standard main module unit and a set of dies and molds for the accessory module unit. By this means, there is no need of repeatedly making new molds, so the overall installation cost for dies and molds can be significantly reduced. As a result, the industrial competitiveness can be improved due to reduced manufacturing cost. This is the main objective for the present invention.

DETAILED DESCRIPTION OF THE PREFERRED EMBODIMENT

Please refer to figures from FIG. 1 to FIG. 4. The stackable board-to-board module connector for the present invention is mainly composed of a main module unit 1, at least an accessory module unit 2, and several first terminals 3 and second terminals 4.

Figure 4:
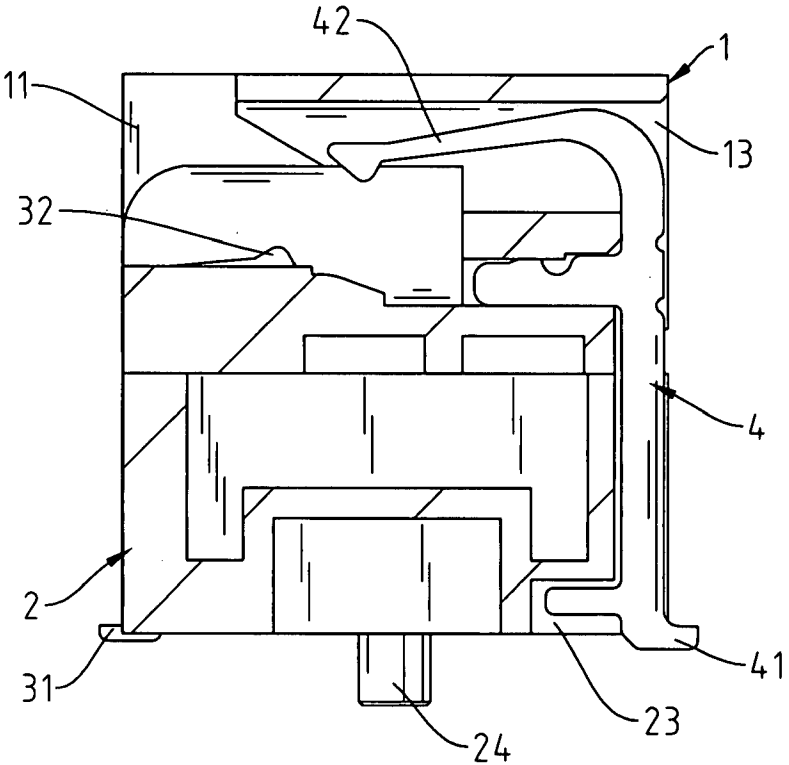
FIG. 4 is the assembly relationship for the second terminal for the present invention.
Figure 3:
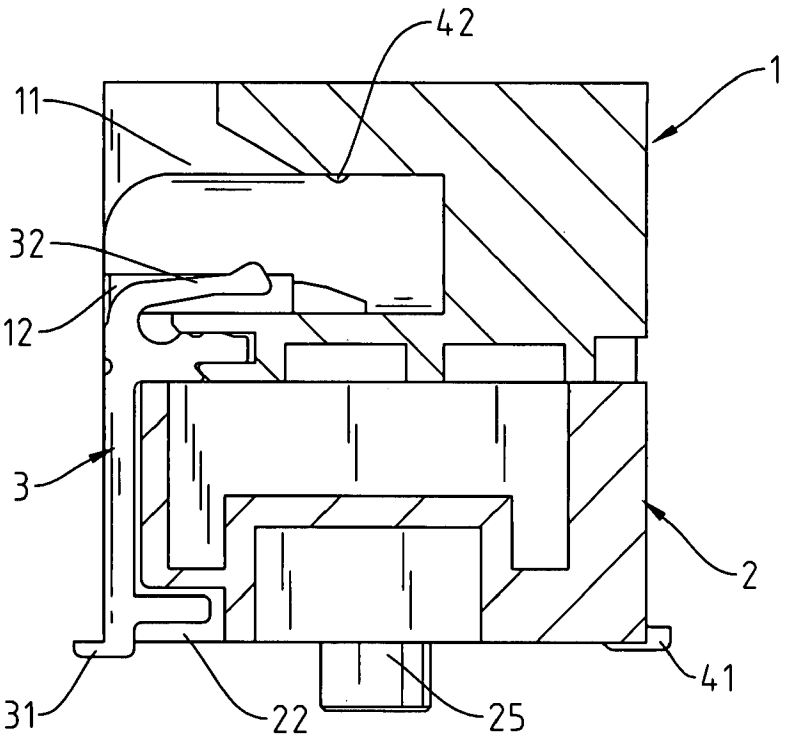
FIG. 3 is the assembly relationship for the first terminal for the present invention.

The main module unit 1 is on the top of connector with slots 11 on its front side for memory modules to insert into. On the side of the slot, there are several first slots 12 and second slots 13 for the first terminals 3 and the second terminals 4 to insert into respectively. Solder pins 31, 41 are exposed out of the main module unit 1 for soldering with a circuit board. Contact terminals 32, 42 stick out of the slots 11 for electric connection with the contact terminals of the board-to-board sub-module (as shown in FIG. 3 and FIG. 4). At the bottom of the main module unit 1, there is a small tenon 14, a large tenon 15 and an insert hole 16 for connection with the accessory module unit 2.

The accessory module unit 2 serves as the bottom of the connector with extending flanges 21 on both sides, which have grooves 211 on the surface for a solder plate to insert into. The solder plate is to connect a circuit board and position the accessory module unit 2. Further, the accessory module unit 2 also has several first slots 22 and second slots 23 that match the first slots 12 and second slots 13 of the main module unit 1 for the first terminal 3 and the second terminal 4 to insert into. Solder pins 31, 41 are exposed out of the accessory module unit 2 for soldering with a circuit board.

Figure 1:
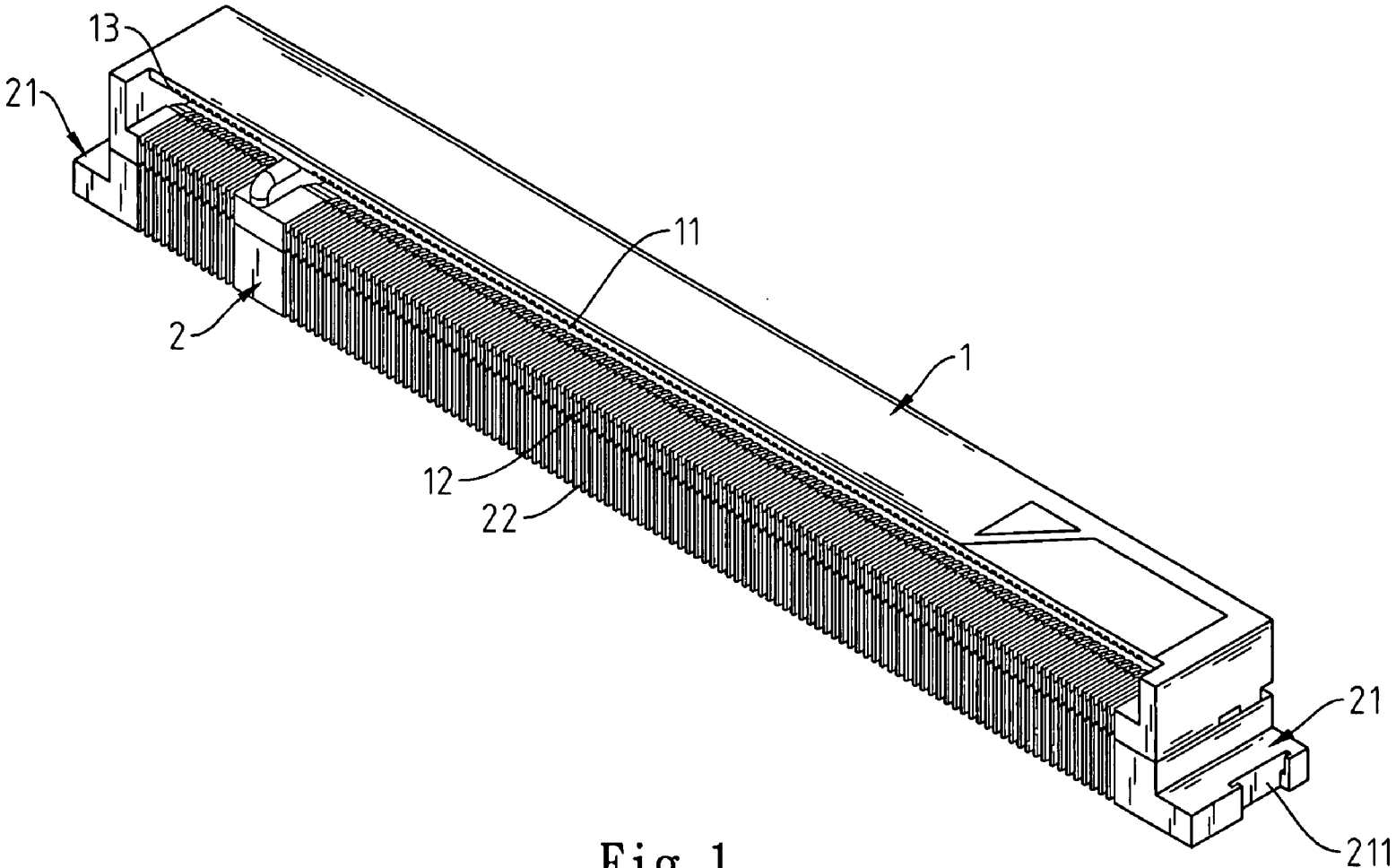
FIG. 1 is the stacking combination of a main module unit and an accessory module unit for the present invention.
Figure 2:
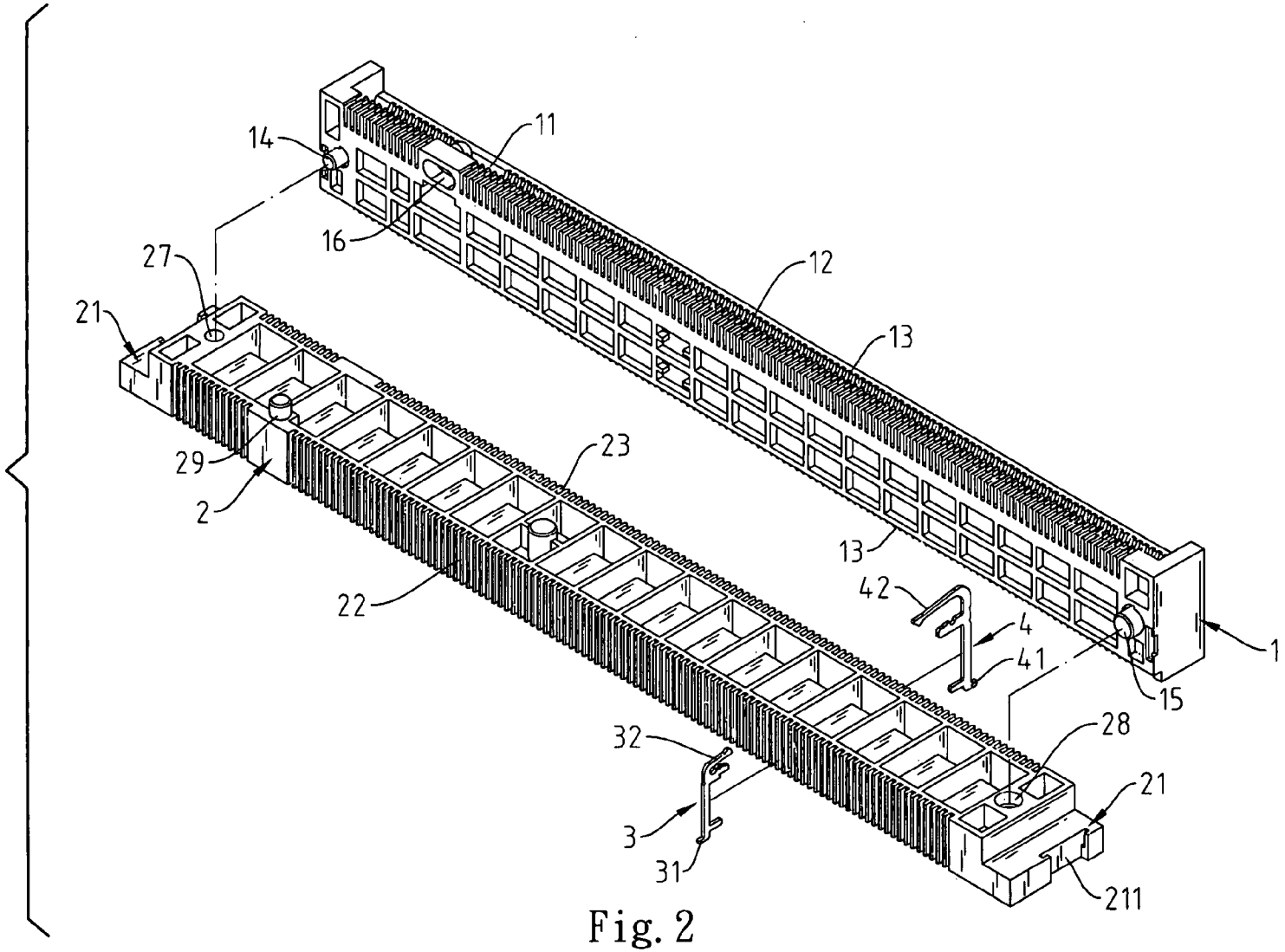
FIG. 2 is the assembly relationship among components for the present invention.
Figure 5:
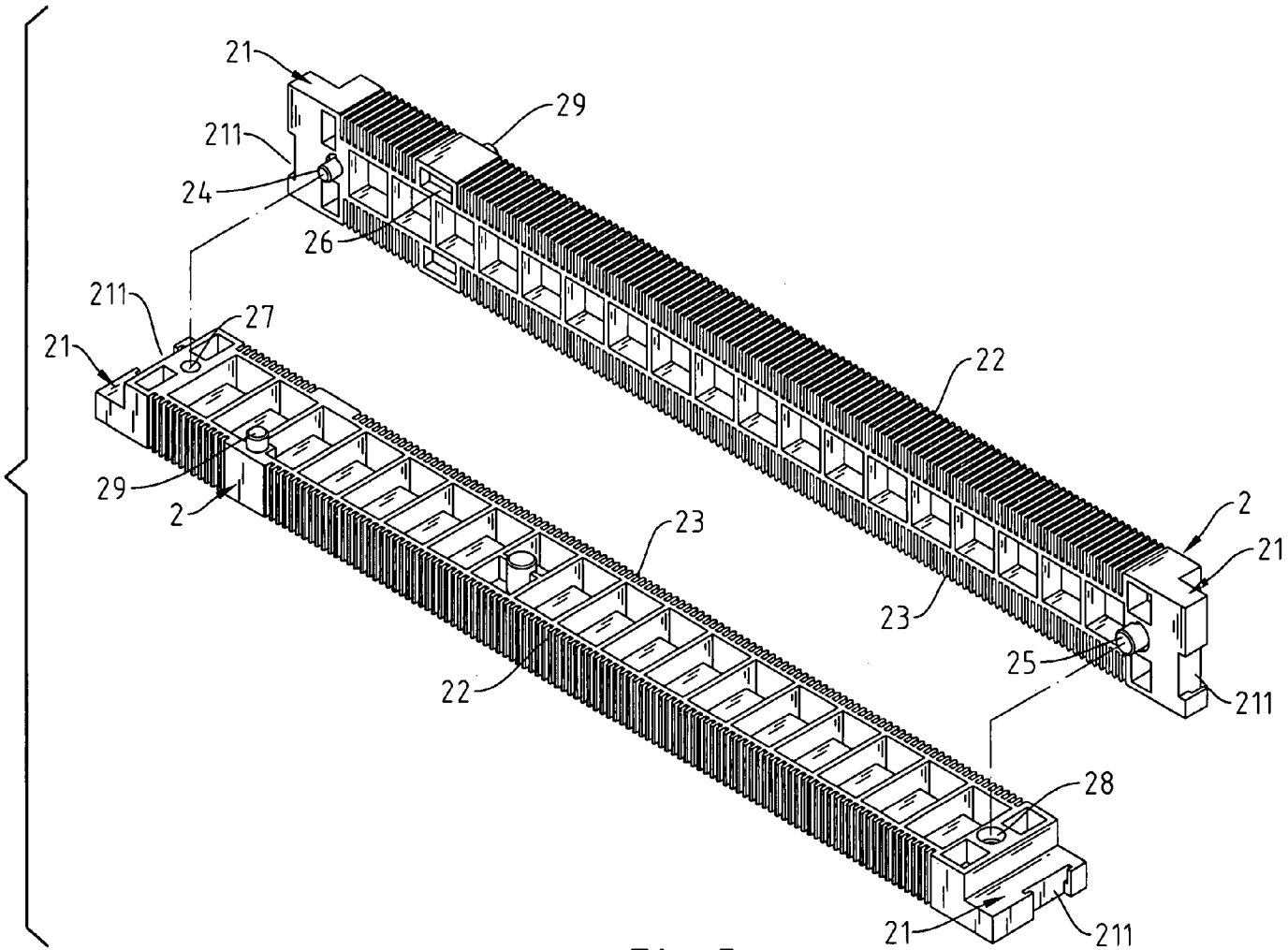
FIG. 5 is the assembly relationship between the main module unit and the accessory module unit for the present invention.

Please refer to FIG. 2 and FIG. 5. The accessory module unit 2 also has a small tenon 24, a large tenon 25 and an insert hole 26 that match the small tenon 14, the large tenon 15 and the insert hole 16 of the main module unit 1. On the top of the accessory module unit 2, there are a small insert hole 27, a large insert hole 28 and a foolproof tenon 29 that match the small tenon 14, the large tenon 15 and the insert hole 16 of the main module unit 1. The locking and fool proof effect between the small tenon 14, the large tenon 15, the insert hole 16 and the small insert hole 27, the large insert hole 28, the fool proof tenon 29 makes a firm connection of the main module unit 1 and the accessory module unit 2.

Figure 6:
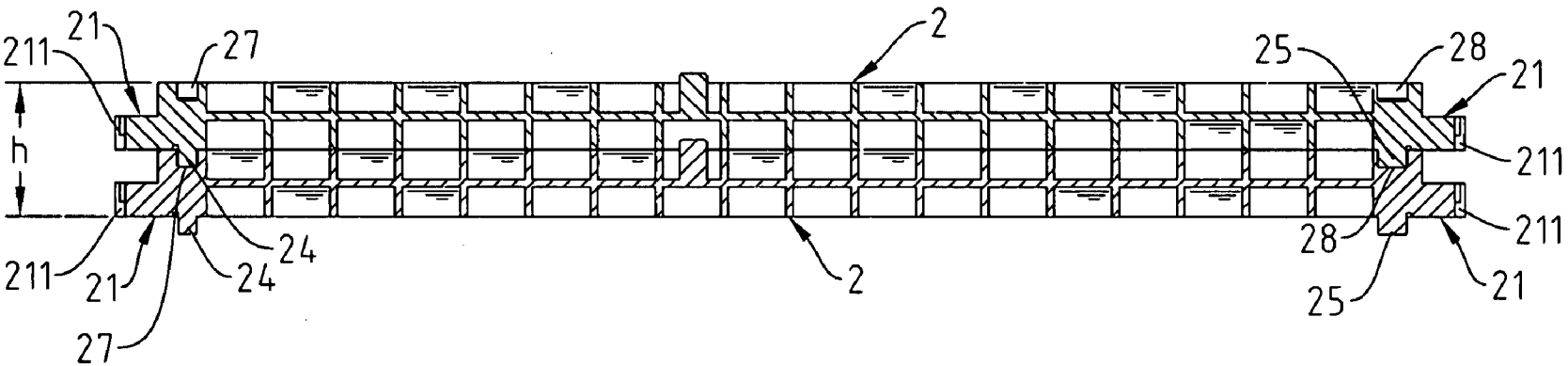
FIG. 6 is the cross-section view of the stacking combination of the main module unit and the accessory module unit for the present invention.

Therefore, the memory module connector constructed in the invention is to firmly connect a main module unit 1 and an accessory module unit 2. The main module unit 1 can be a standard device, while the accessory module unit can be an independent device that serves as a stackable accessory to adjust the height according to the total height requirement of board-to-board module connector. As shown in FIG. 5 and FIG. 6, a couple of the accessory module units 2 can be combined to form the bottom of a board-to-board module connector. Certainly, the height of the accessory module unit 2 varies. If we need to manufacture a board-to-board module connector that is higher than the combination of a main module unit 1 and an accessory module unit 2, the number of the main module unit 1 remains unchanged and the remaining height h can be achieved by stacking a number of accessory module units 2. Thus, the connector in the invention is a stackable board-to-board module connector with adjustable height.

In summary, the stackable board-to-board module connector with adjustable height in the present invention is composed of a main module unit 1 or a stack of accessory module units 2, i.e. achievable by a set of dies and molds for the main module unit 1 and a set of dies and molds for the accessory module unit 2. Besides, the mold design for the accessory module unit 2 has lower technical requirement than the main module unit 1. So the installation cost will be greatly reduced. The only consideration is put on the control over entire surface accuracy for the accessory module unit 2, i.e. the compatibility with the main module unit 1 with respect to combination of two units. The overall technical requirement for a manufacturing process will be lower if the accessory module unit is included. For the sake of manufacturing cost, to manufacture board-to-board module connectors in different height specifications we only need a set of dies and molds for the standard main module unit 1 and a set of dies and molds for the accessory module unit 2. The required height can be achieved by embedding a stack of accessory module units 2 under the main module unit 1. By this means, there is no need of repeatedly making new molds, so the overall installation cost for dies and molds can be significantly reduced. As a result, the industrial competitiveness can be improved due to reduced manufacturing cost. This invention proves to possess great commercial value.

What the invention claimed is:

1. A stackable board-to-board module connector assembly comprising a main module unit, at least one accessory module unit and several first terminals and second terminals: the main module unit is a top connector with a slot on a front side thereof for memory modules to insert into, on a side of the slot there are several first slots and several second slots for the first terminals and the second terminals to insert into respectively, at a bottom of the main module unit, there is a small tenon, a large tenon and an insert hole for connection with the accessory module unit; the accessory module unit serves as a bottom connector for the connector assembly having extending flanges on both sides thereof, the flanges having grooves on a surface thereof for a solder plate to insert into; the solder plate is to connect to a circuit board and position the accessory module unit; the accessory module unit also has several first slots and several second slots that match the first slots and second slots of the main module unit; the accessory module unit also has a small insert hole, a large insert hole and a fool proof tenon; a locking and fool proof effect exists between the small tenon, the large tenon, the insert hole, and the small insert hole, the large insert hole and the fool proof tenon, providing a firm connection of the main module unit and the accessory module unit; by this means, a stackable board-to-board module connector is constructed.

2. The stackable board-to-board memory module connector assembly as claimed in claim 1, wherein at a bottom of the accessory module unit there also are a small tenon, a large tenon and an insert hole that match the small tenon, the large tenon and the insert hole of the main module unit for a number of accessory module units to combine into a board-to-board module connector assembly.

* * * * *